US012582241B1

(12) United States Patent
Muti

(10) Patent No.: US 12,582,241 B1
(45) Date of Patent: Mar. 24, 2026

(54) FRONT OPENING CRIB ASSEMBLY AND METHOD OF USE

(71) Applicant: Alisi Muti, Mountain View, CA (US)

(72) Inventor: Alisi Muti, Mountain View, CA (US)

( * ) Notice: Subject to any disclaimer, the term of this patent is extended or adjusted under 35 U.S.C. 154(b) by 21 days.

(21) Appl. No.: 18/896,171

(22) Filed: Sep. 25, 2024

(51) Int. Cl.
*A47D 9/00* (2006.01)

(52) U.S. Cl.
CPC ..... *A47D 9/00* (2013.01)

(58) Field of Classification Search
CPC ..... A47C 19/045; A47C 20/041; A47D 9/00; A47D 9/005; A47D 9/008; A47D 9/012; A61G 7/051
USPC ..... 5/100
See application file for complete search history.

(56) References Cited

U.S. PATENT DOCUMENTS 2,477,231 A * 7/1949 Bourdon ..... A47D 11/007 5/100
2,555,160 A * 5/1951 Schwarz ..... A47D 9/012 5/93.1
2,632,186 A * 3/1953 Berk ..... A47D 9/016 5/99.1
2,698,442 A * 1/1955 Travis ..... A61G 7/005 248/188.5
3,670,344 A * 6/1972 Boudreau ..... A47B 91/02 5/100
D231,874 S * 6/1974 Weigel ..... 5/100
4,057,240 A * 11/1977 Damico ..... A61G 13/0018 5/617
6,550,082 B2 4/2003 Tharalson
6,938,286 B1 * 9/2005 Smith ..... A47D 9/012 5/100
D594,245 S * 6/2009 Hagstrom ..... D6/390
7,827,631 B2 * 11/2010 Holman ..... A47D 9/012 5/100
8,566,979 B1 * 10/2013 Kayser ..... A47D 7/00 5/100
8,640,280 B2 2/2014 Gutierrez
10,051,970 B1 * 8/2018 Kramer ..... A47C 20/041
2009/0070929 A1 3/2009 Holman
2010/0000016 A1 * 1/2010 Aiken ..... A47D 7/01 5/93.1
2012/0167299 A1 7/2012 Tarquino
2014/0026317 A1 * 1/2014 Kayser ..... A47D 7/01 5/100

(Continued)

FOREIGN PATENT DOCUMENTS

CN 219353468 7/2023
DE 202014104738 U1 * 11/2014 ..... A47D 9/012

(Continued)

*Primary Examiner* — Eric J Kurilla

(57) ABSTRACT

A front opening crib assembly for easing the task of child placement and retrieval includes a sleeping structure, which in turn comprises rear, bottom and a pair of side panels, a pair of doors, and a latching device. Each side panel has a rear edge that is attached to a respective opposed edge of the rear panel. The bottom panel is attached to of the side panels proximate to their lower edges and to the rear panel proximate to its bottom edge. The bottom panel supports a mattress pad. Each door is hingedly attached to a respective side panel proximate its front edge. The panels and doors define a sleep space that is substantially cuboid, open topped, and accessible by swinging the doors outwardly. The latching device selectively secures the doors in a closed configuration.

12 Claims, 10 Drawing Sheets

(56) References Cited

U.S. PATENT DOCUMENTS

| | | | | |
|---|---|---|---|---|
| 2017/0150824 | A1* | 6/2017 | Saavedra | A61G 7/012 |
| 2018/0049561 | A1* | 2/2018 | Smeltz | A47C 21/08 |
| 2021/0145186 | A1 | 5/2021 | Mu | |

FOREIGN PATENT DOCUMENTS

| | | | | |
|---|---|---|---|---|
| DE | 202024000804 | U1 * | 6/2024 | A47D 9/00 |
| EP | 3001999 | A1 * | 4/2016 | A47D 9/012 |
| GB | 2267822 | A * | 12/1993 | A47D 9/012 |
| GB | 2479589 | A * | 10/2011 | A47D 7/01 |

* cited by examiner

FRONT OPENING CRIB ASSEMBLY AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to crib assemblies and more particularly pertains to a new crib assembly for easing the task of child placement and retrieval. A caretaker of a child, especially a mother of a newborn child, may have difficulty managing placement of the infant into prior art cribs as this requires the caretaker to manage the weight of the child while bending over a front face of the crib. The mattress pads of prior art cribs also are generally positioned low in the prior art cribs and exacerbates the difficulty in positioning the child.

(2) Description of Related Art Including Information Disclosed Under 37 CFR 1.97 and 1.98

The prior art relates to crib assemblies, which may include crib assemblies having removable front walls wherein the crib assemblies are attachable to beds. The prior art also includes crib assemblies wherein the mattress pad supports are vertically adjustable relative to frames of the crib assemblies. What is lacking in the prior art is a crib assembly having outwardly swinging doors for accessing a sleeping area of the crib assembly. Also lacking in the prior art is a crib assembly wherein the entire structure can be selectively elevated.

BRIEF SUMMARY OF THE INVENTION

An embodiment of the disclosure meets the needs presented above by generally comprising a sleeping structure, which in turn comprises a rear panel, a pair of side panels, a bottom panel, a pair of doors, and a latching device. The rear panel has opposed edges, a top edge, and a bottom edge. Each side panel has a rear edge, a front edge, an upper edge, and a lower edge. Each rear edge is attached to a respective opposed edge of the rear panel so that the side panels extend perpendicularly to and in parallel from the rear panel. The bottom panel is attached to of the side panels proximate to the lower edges of the side panels and to the rear panel proximate to the bottom edge of the rear panel. The bottom panel thus is configured to support a mattress pad. Each door is hingedly attached to a respective side panel proximate to the front edge of the respective side panel. The rear panel, the side panels, the bottom panel, and the doors in a closed configuration define a sleeping space that is substantially cuboid and open topped. The doors swinging outwardly from the closed configuration to an open configuration, wherein the sleeping space is accessible by reaching between the doors. The latching device is attached to and extends between the doors so that the doors are selectively securable in the closed configuration.

Another embodiment of the disclosure includes the sleeping structure, as disclosed above but also comprising a controller and a plurality of linear actuators attached to the sleeping structure. The linear actuators, under the direction of the controller, are configured to selectively elevate the sleeping structure from a surface upon which it is positioned while maintaining the bottom panel parallel to the surface.

Yet another embodiment of the disclosure includes a method of using a selectively elevatable front opening crib. The method entails providing a front opening crib assembly equipped with linear actuators, as per the disclosure above. Additional steps of the method include manipulating the controller to elevate the sleeping structure to a height desired to position a child into the sleeping space. A third step of the method is swinging the doors outwardly so that the sleeping space is accessible. A fourth step of the method is positioning the child on the mattress pad in the sleeping space. A fifth step of the method is closing and latching the doors. A sixth step of the method is manipulating the controller to lower the sleeping structure to a desired resting height.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
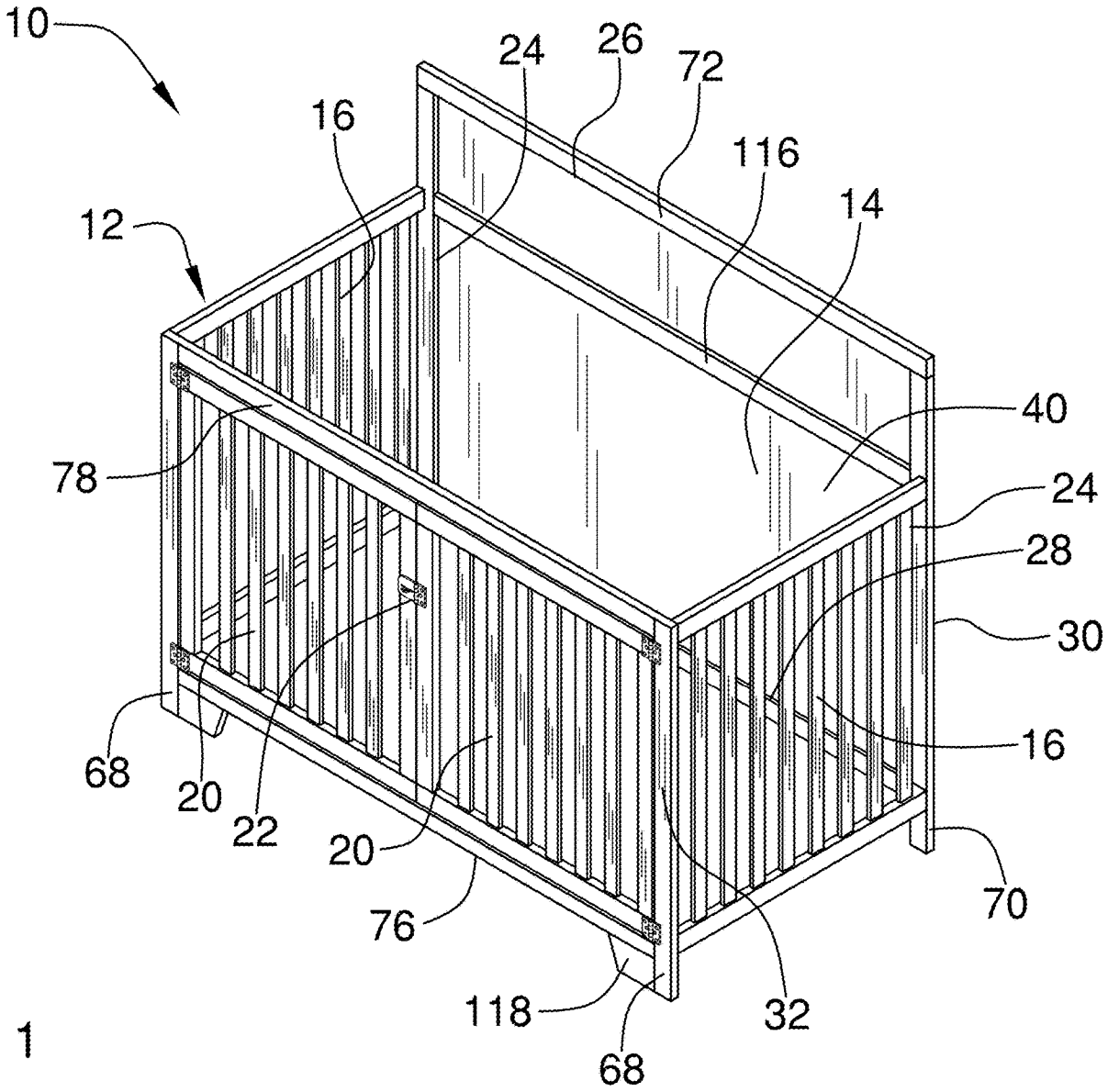
FIG. 1 is an isometric perspective closed view of a front opening crib assembly according to an embodiment of the disclosure.
Figure 2:
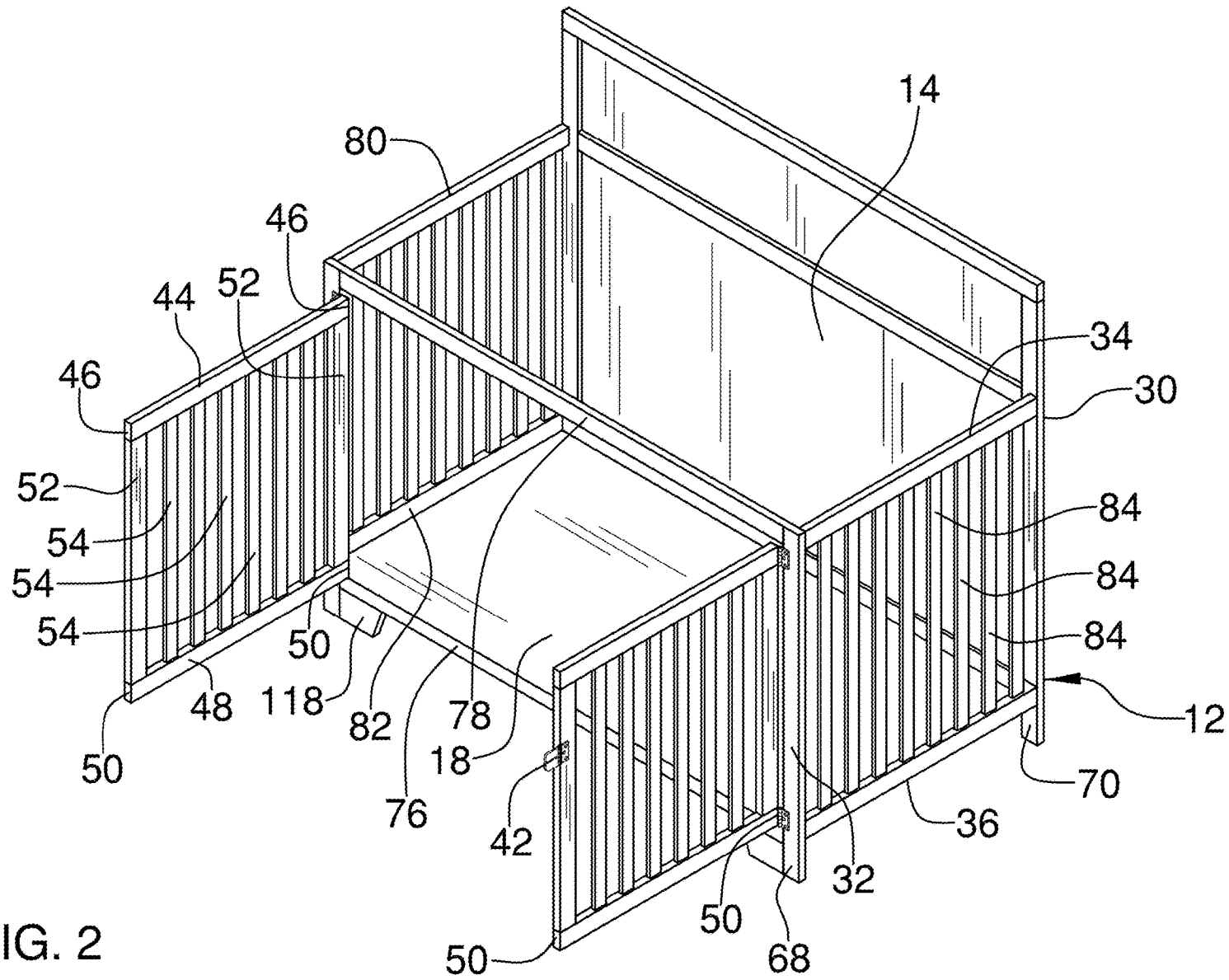
FIG. 2 is an isometric perspective open view of an embodiment of the disclosure.

With reference now to the drawings, and in particular to FIGS. 1 through 13 thereof, a new crib assembly embodying the principles and concepts of an embodiment of the disclosure and generally designated by the reference numeral 10 will be described.

As best illustrated in FIGS. 1 through 13, the front opening crib assembly 10 generally comprises a sleeping structure 12, which in turn comprises a rear panel 14, a pair of side panels 16, a bottom panel 18, a pair of doors 20, and a latching device 22. The rear panel 14 has opposed edges 24, a top edge 26, and a bottom edge 28. Each side panel 16 has a rear edge 30, a front edge 32, an upper edge 34, and a lower edge 36. Each rear edge 30 is attached proximate to a respective opposed edge 24 of the rear panel 14 so that the side panels 16 extend perpendicularly to and in parallel from the rear panel 14. The bottom panel 18 is attached to of the side panels 16 proximate to the lower edges 36 of the side panels 16 and to the rear panel 14 proximate to the bottom edge 28 of the rear panel 14. The bottom panel 18 thus is configured to support a mattress pad 38.

Figure 7:
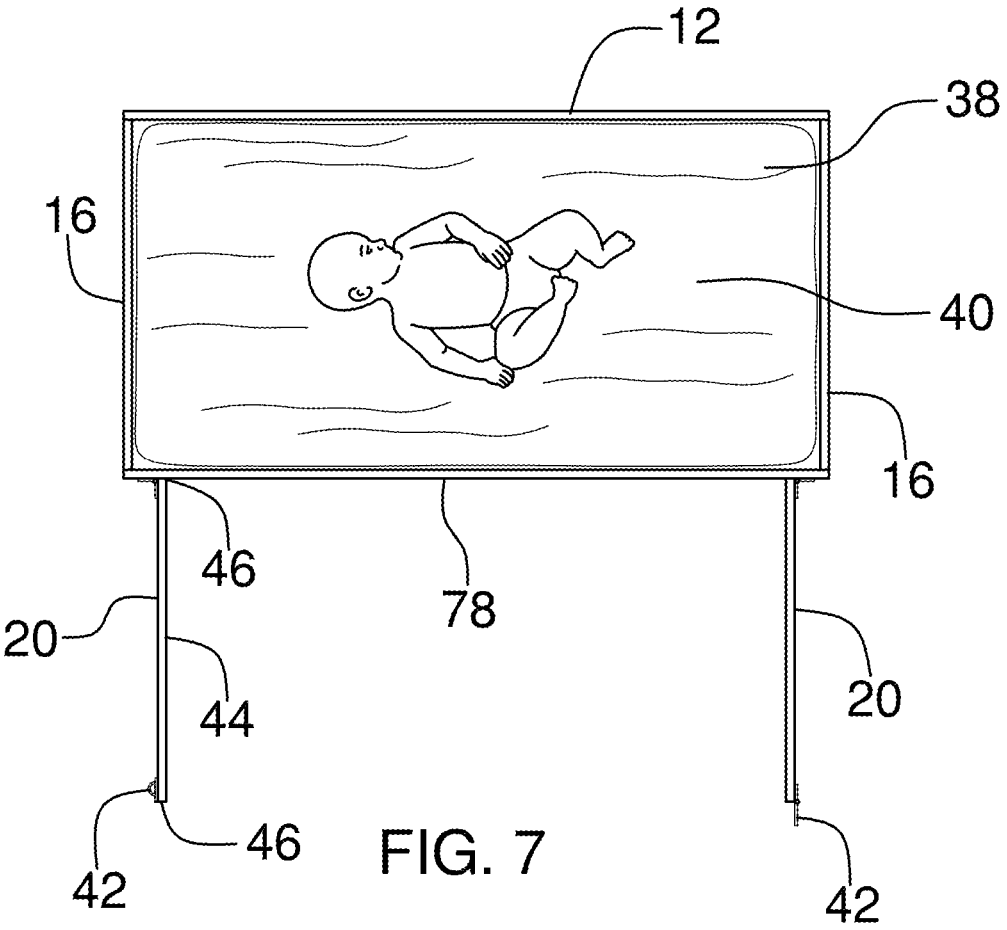
FIG. 7 is a top closed view of an embodiment of the disclosure.
Figure 8:
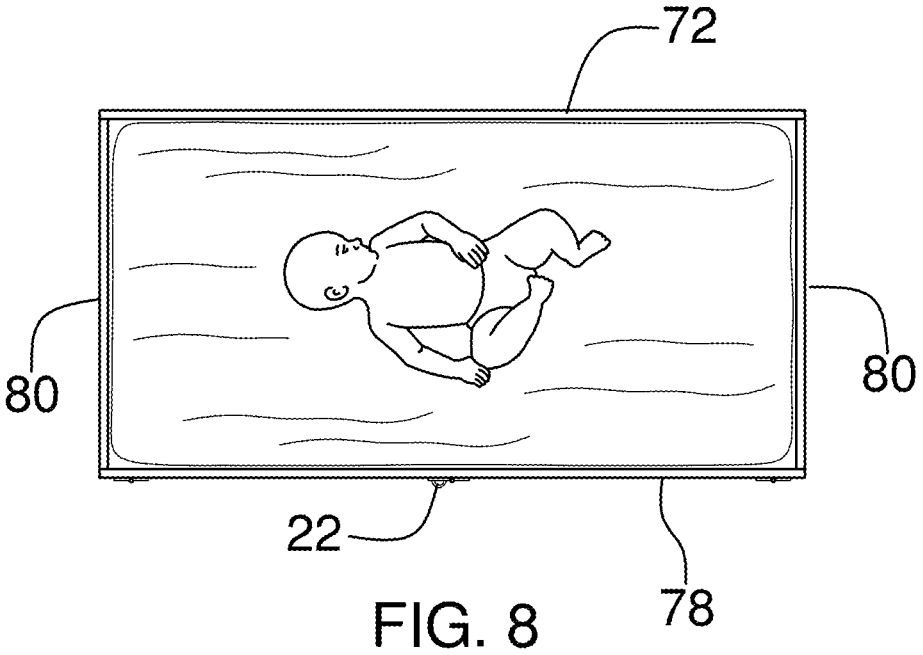
FIG. 8 is a top open view of an embodiment of the disclosure.

Each door 20 is hingedly attached to a respective side panel 16 proximate to the front edge 32 of the respective side panel 16. The rear panel 14, the side panels 16, the bottom panel 18, and the doors 20 in a closed configuration, as shown in FIG. 8, define a sleeping space 40 that is substantially cuboid and open topped. The doors 20 swinging outwardly from the closed configuration to an open configuration, as is shown in FIG. 7, wherein the sleeping space 40 is accessible by reaching between the doors 20. The latching device 22 is attached to and extends between the doors 20 so that the doors 20 are selectively securable in the closed configuration. Latching devices 22 are well known in the prior art and may comprise captured draw bolt-style latches, cam locks, a hasp latch lock 42, as is shown in FIG. 1, or the like.

Each door 20 comprises a top rail 44, which has opposed ends 46, a bottom rail 48, which has opposing ends 50, a pair of end members 52, and a plurality of front balusters 54. Each end member 52 is attached to the top rail 44 proximate to a respective opposed end 46 of the top rail 44. The end member 52 also is attached to the bottom rail 48 proximate to an associated opposing end 50 of the bottom rail 48 so that the end member 52 extends between the top rail 44 and the bottom rail 48. The plurality of front balusters 54 is attached to and extends between the top rail 44 and the bottom rail 48 so that the front balusters 54 are substantially evenly spaced between the end members 52.

The rear panel 14 is continuous and without openings. The rear panel 14 is dimensionally taller than the side panels 16 and is configured to prevent a child in the sleeping space 40 from contacting a wall proximate to the rear panel 14. The rear panel 14 can prevent damage to the wall proximate to the rear panel 14 and prevent the child from accessing outlets positioned in the wall by reaching through or over the rear panel 14.

Each side panel 16 comprises a rear post 56 and a front post 58. The rear post 56 defines the rear edge 30 of the side panel 16, is tubular, and has a closed upper end 60 and an open lower end 62. The rear panel 14 is attached to and extends between the rear posts 56. The front post 58 defines the front edge 32 of the side panel 16. Each door 20 is hingedly attached to a respective front post 58. The front post 58 is tubular and has a closed top end 64 and an open bottom end 66. The rear posts 56 and the front posts 58 may extend past the bottom panel 18 to define front legs 68 and rear legs 70, respectively.

Figure 3:
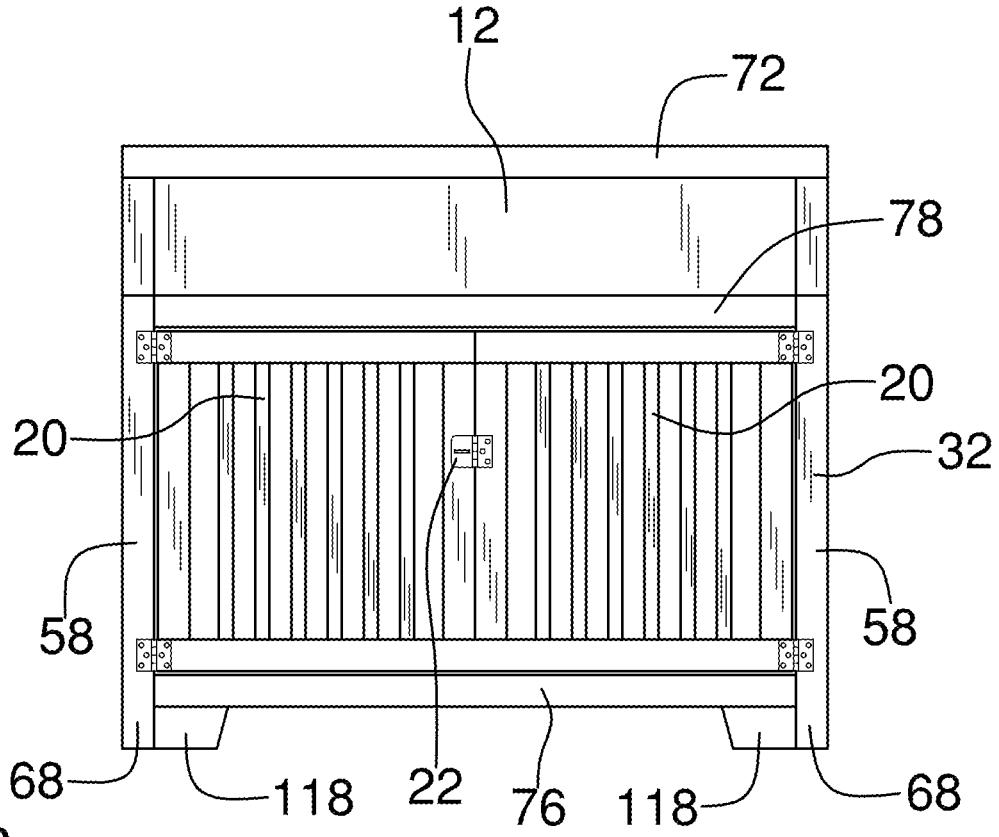
FIG. 3 is a front view of an embodiment of the disclosure.
Figure 4:
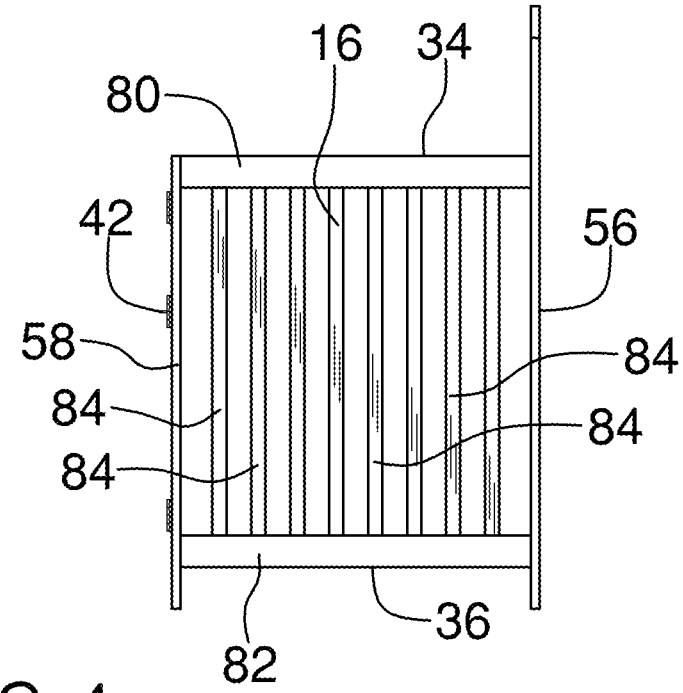
FIG. 4 is a side view of an embodiment of the disclosure.
Figure 5:
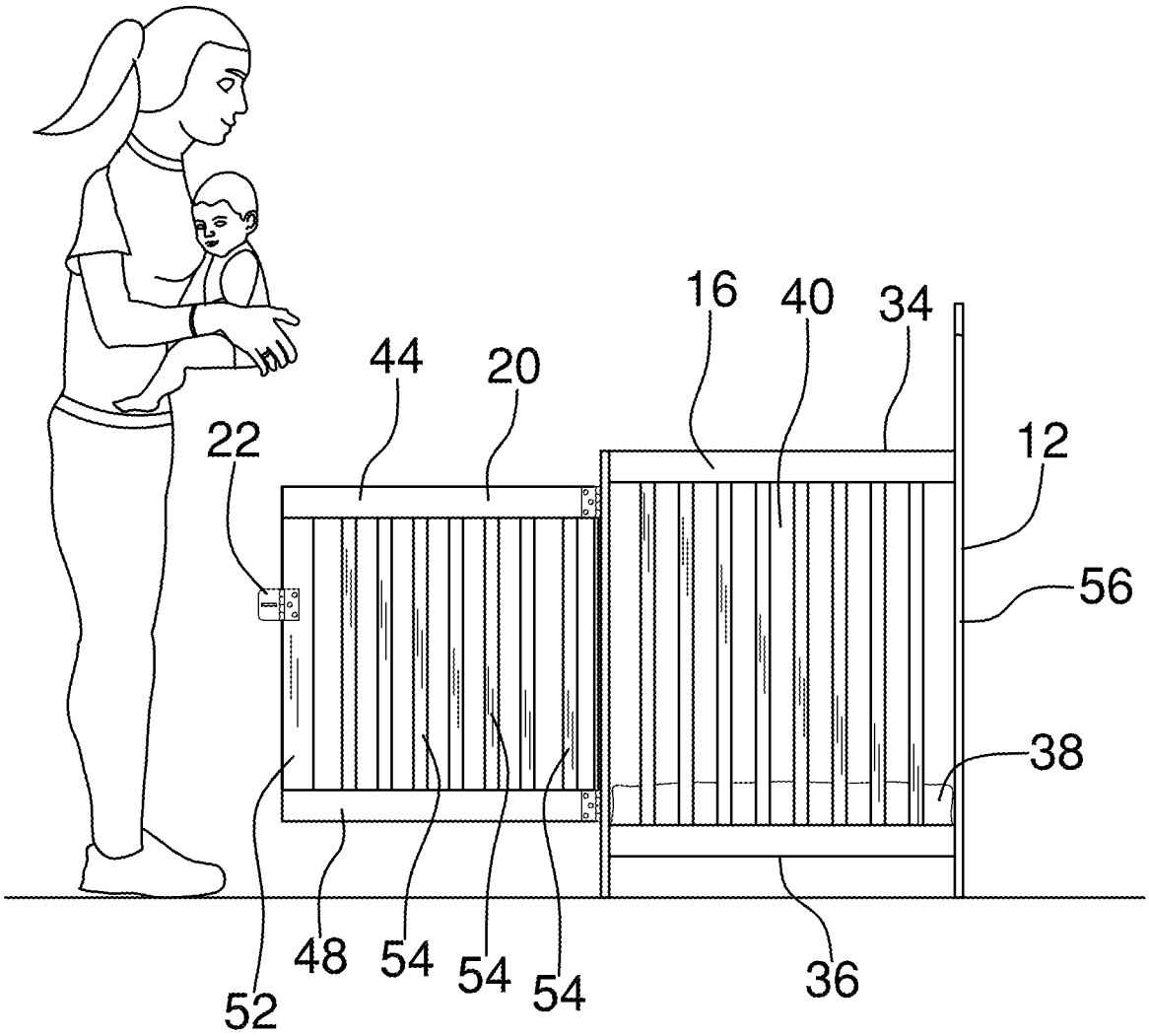
FIG. 5 is a side in-use view of an embodiment of the disclosure.
Figure 6:
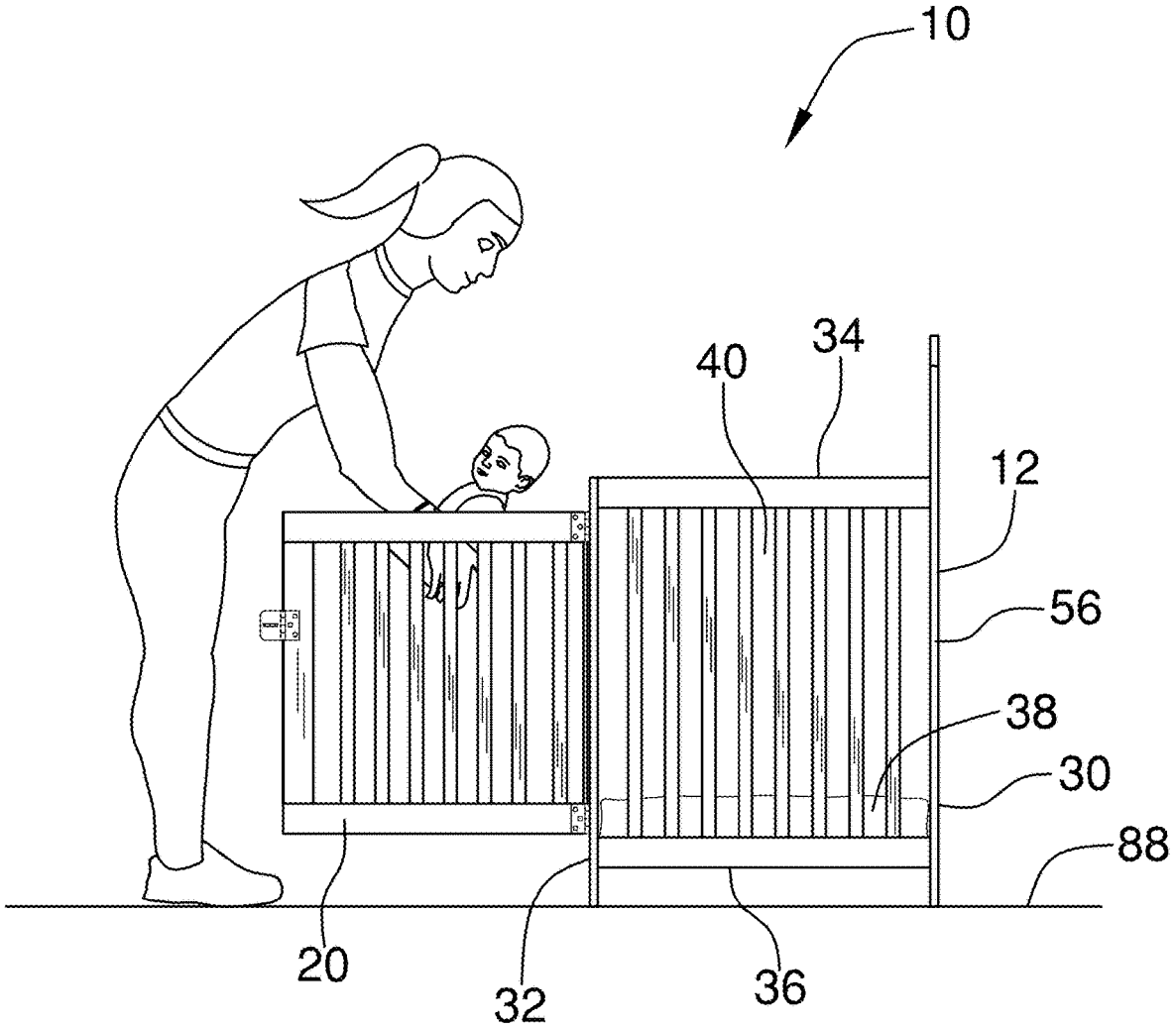
FIG. 6 is a side in-use view of an embodiment of the disclosure.

The rear panel 14 comprises a top support rail 72, which defines the top edge 26 of the rear panel 14. The top support rail 72 is attached to and extends between the rear posts 56. The rear panel 14 also comprises a bottom support rail 74, which defines the bottom edge 28 of the rear panel 14. The bottom support rail 74 is attached to and extends between the rear posts 56. A lower support rail 76 is attached to and extends between the front posts 58. The lower support rail 76 is attached to the bottom panel 18. Also anticipated is a pair of braces 118, with each brace 118 being attached to the lower support rail and a respective one of the front posts 58, thereby supporting the lower support rail 76 and rigidifying the sleeping assembly 12. Further rigidifying the sleeping assembly 12 is a stiffening rail 78, which is attached to and extends between the front posts 58 so that the stiffening rail 78 is positioned above the doors 20 in the closed configuration, as is shown in FIGS. 1 and 3.

Each side panel 16 also comprises an upper rail 80, a lower rail 82, and a plurality of side balusters 84. The upper rail 80 and the lower rail 82 define the upper edge 34 and the lower edge 36 of the side panel 16, respectively. The plurality of side balusters 84 is attached to and extends between the upper rail 80 and the lower rail 82 so that the side balusters 84 are substantially evenly spaced between the rear post 56 and the front post 58 of the side panel 16. The rear panel 14 also may comprise a medial support rail 116, is attached to and extends between the rear posts 56 and which is coplanar with the upper rails 80 of the side panels 16.

Each linear actuator 86 of a plurality of linear actuators 86 are attached to a respective rear post 56 or a respective front post 58 so that each rear post 56 and each front post 58 is fitted with an associated one of the linear actuators 86. The plurality of linear actuators 86 is configured to selectively elevate the sleeping structure 12 from a surface 88 upon which the sleeping structure 12 is positioned while maintaining the bottom panel 18 parallel to the surface 88.

As is shown in FIGS. 9-12, the plurality of linear actuators 86 comprises a plurality of hydraulic cylinders 90. A hydraulic pump 98 is attached to the sleeping structure 12 and is operationally engaged to the plurality of hydraulic cylinders 90. Each hydraulic cylinder 90 comprises a piston 92. The piston 92 is selectively extensible from the sleeping structure 12 to engage the surface 88 to elevate the sleeping structure 12 from the surface 88.

Figure 11:
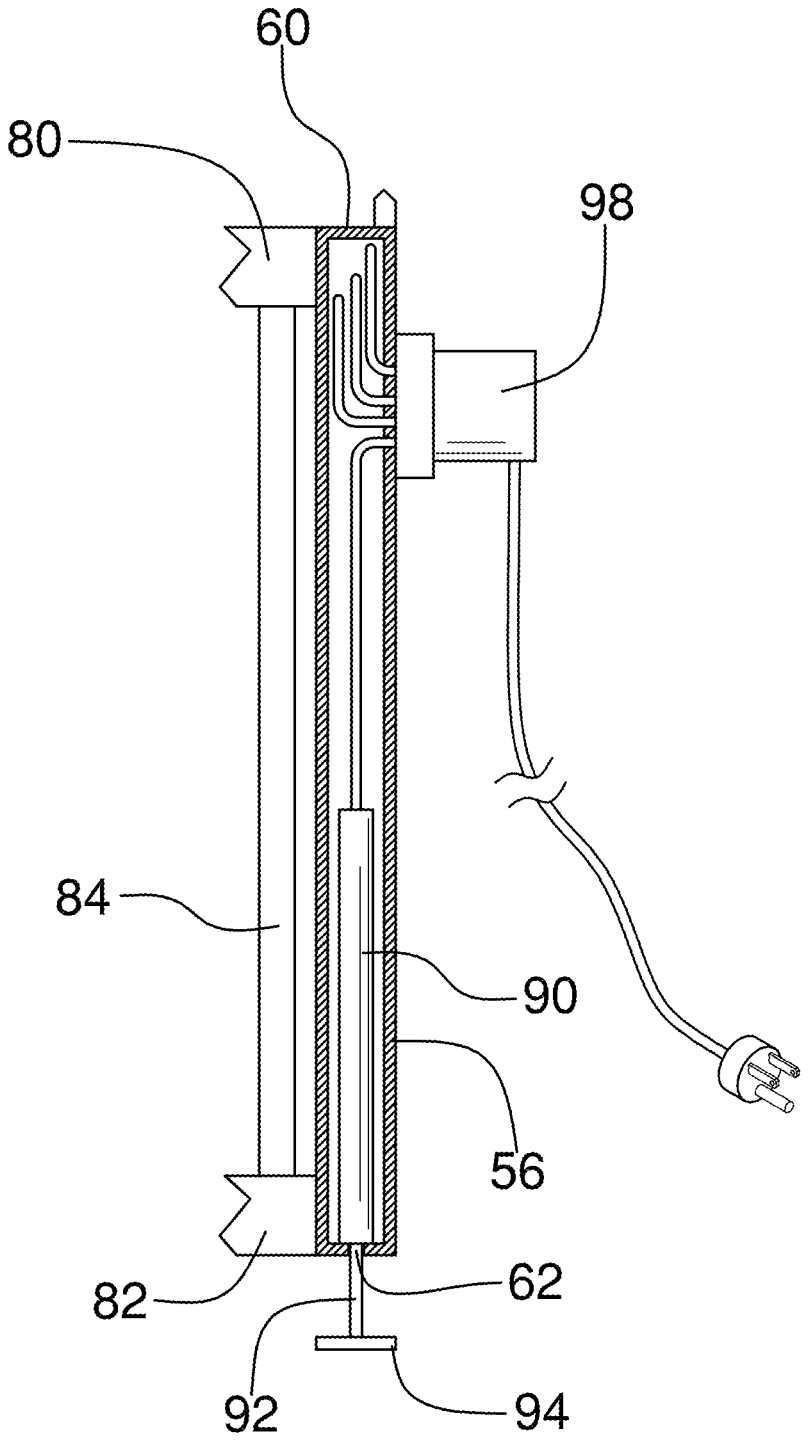
FIG. 11 is a cross-sectional view of an embodiment of the disclosure.

Each linear actuator 86 is positioned within a respective one of the rear posts 56 and the front posts 58, as is shown in FIG. 11. The pistons 92 of the linear actuators 86 that are positioned in the rear posts 56 are selective extensible from the open lower ends 62 of the rear posts 56. The pistons 92 of the linear actuators 86 that are positioned in the front posts 58 are selective extensible from the open bottom ends 66 of the front posts 58. Each footpad 94 of a plurality of footpads 94 is attached to a respective piston 92 so that the footpad 94 is positioned to contact the surface 88. The plurality of footpads 94 thus is configured to stabilize the sleeping structure 12 upon the surface 88.

Figure 9:
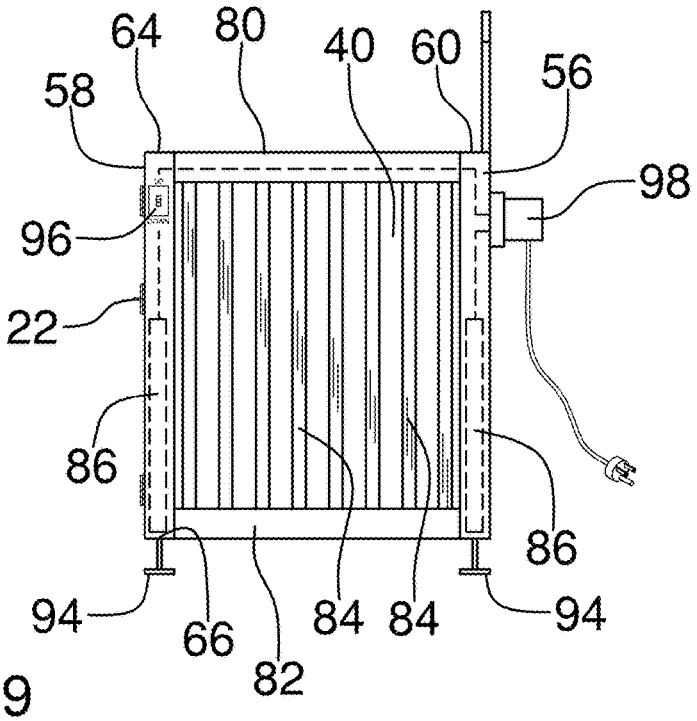
FIG. 9 is a side view of an embodiment of the disclosure.
Figure 10:
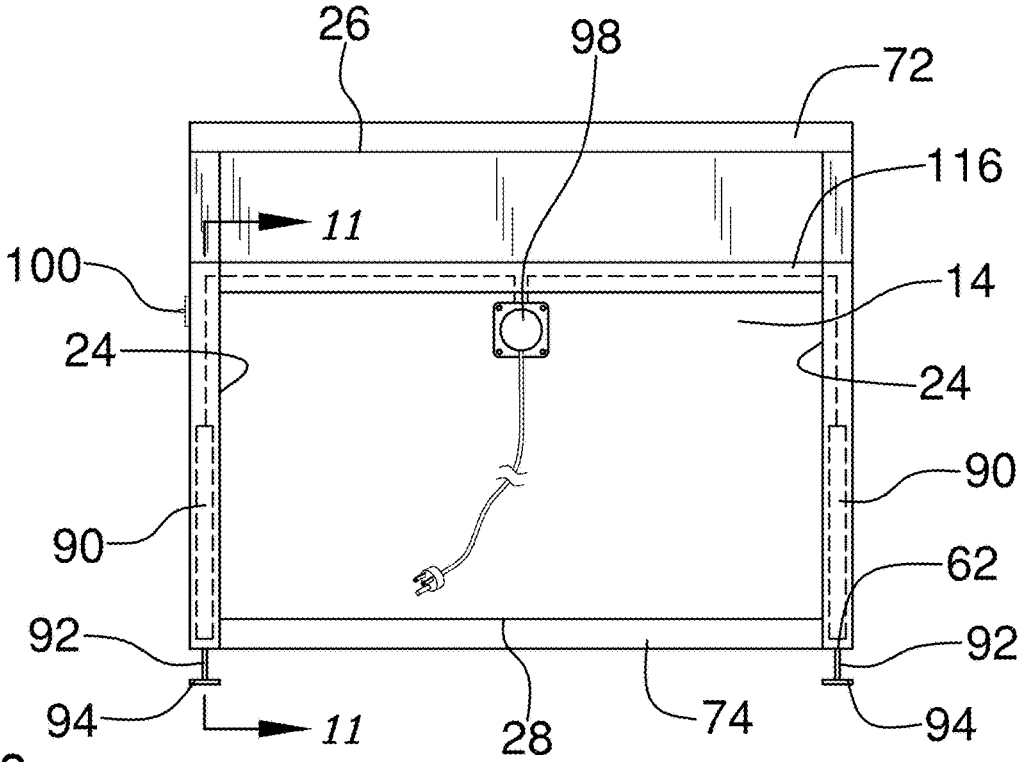
FIG. 10 is a rear view of an embodiment of the disclosure.
Figure 12:
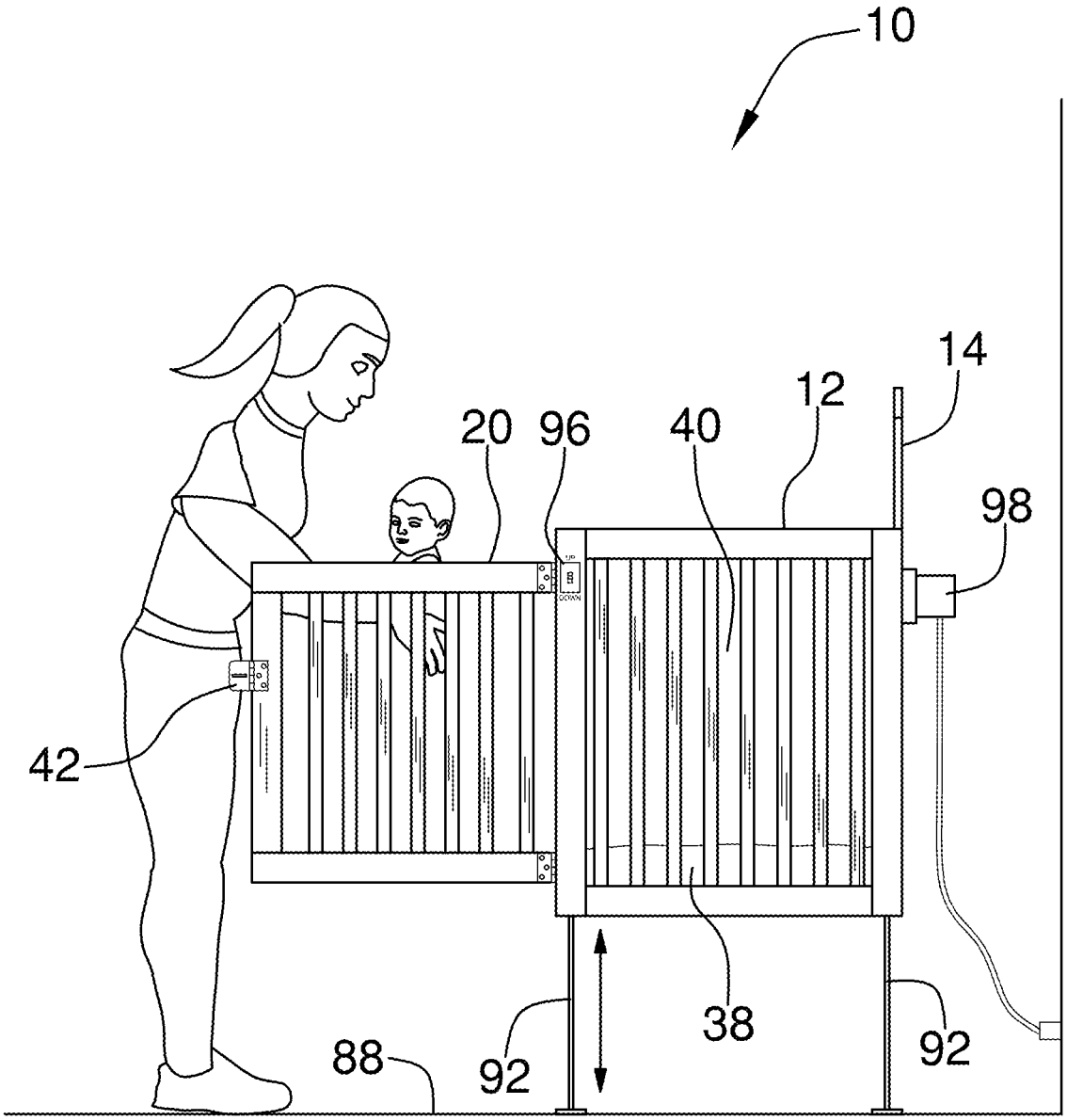
FIG. 12 is an in-use view of an embodiment of the disclosure.
Figure 13:
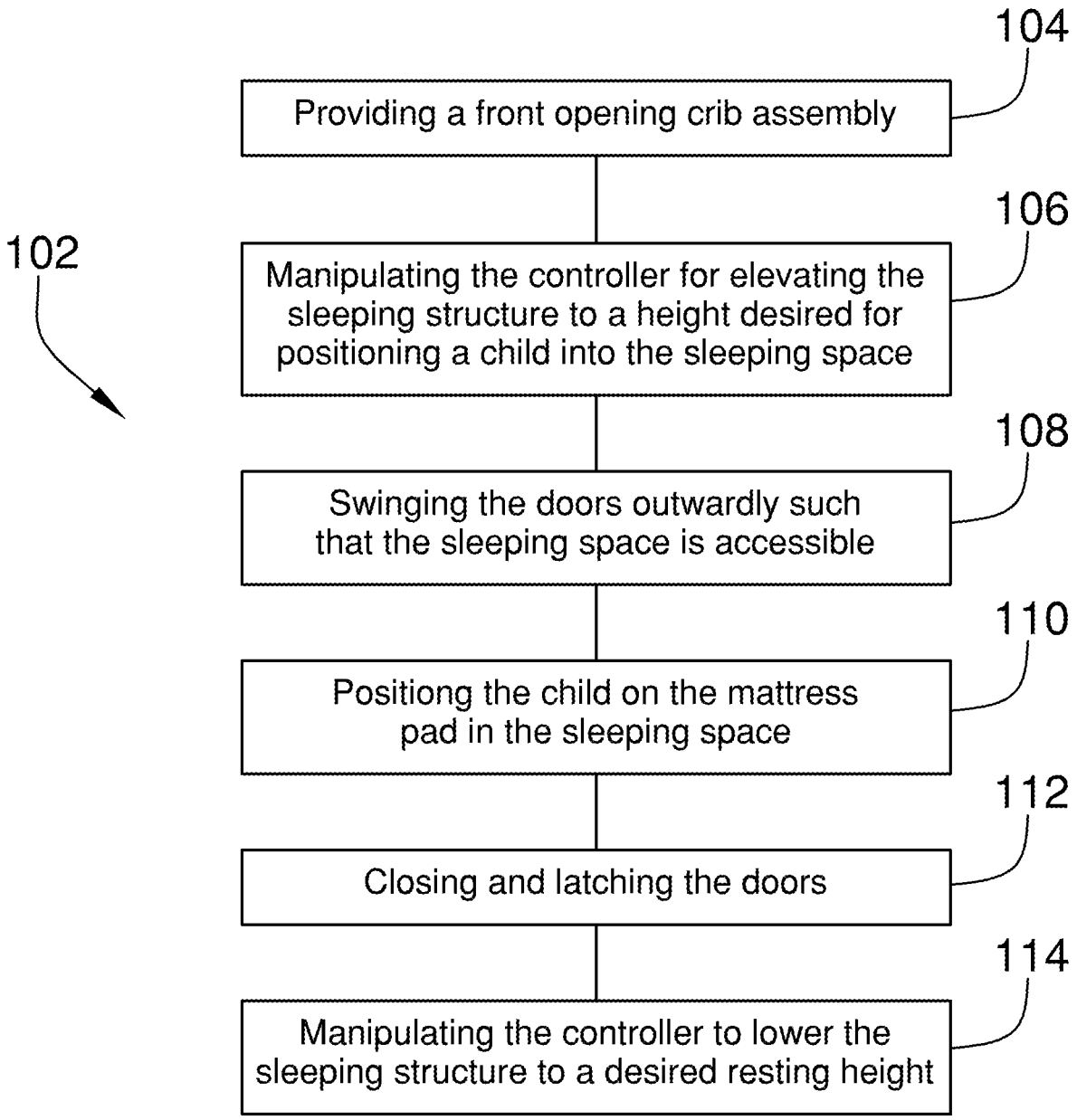
FIG. 13 is a flow diagram for a method utilizing an embodiment of the disclosure.

A controller 96 is operationally engaged to the plurality of linear actuators 86 and to the hydraulic pump 98. The controller 96 is configured to be manipulated by a user to selectively actuate the plurality of linear actuators 86. The controller 96 may comprise an up/down switch 100, which is attached to the sleeping structure 12, as is shown in FIGS. 9 and 12. The controller 96 also may be detached from the sleeping structure 12 and configured to be manipulated by a foot of the user.

In use, the front opening crib assembly 10 enables a method of using a selectively elevatable front opening crib 102. The method 102 comprises a first step 104 of providing a front opening crib assembly 10, as per the specification above. A second step 106 of the method 102 is manipulating the controller 96 to elevate the sleeping structure 12 to a height desired to position a child into the sleeping space 40. A third step 108 of the method 102 is swinging the doors 20 outwardly so that the sleeping space 40 is accessible. A fourth step 110 of the method 102 is positioning the child on the mattress pad 38 in the sleeping space 40. A fifth step 112 of the method 102 is closing and latching the doors 20. A sixth step 114 of the method 102 is manipulating the controller 96 to lower the sleeping structure 12 to a desired resting height.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A front opening crib assembly comprising a sleeping structure, the sleeping structure comprising:

a rear panel having opposed edges, a top edge, and a bottom edge;

a pair of side panels, each side panel having a rear edge, a front edge, an upper edge, and a lower edge, each rear edge being attached proximate to a respective opposed edge of the rear panel such that the side panels extend perpendicularly to and in parallel from the rear panel;

a bottom panel being attached to of the side panels proximate to the lower edges of the side panels and to the rear panel proximate to the bottom edge of the rear panel, wherein the bottom panel is configured to support a mattress pad;

a pair of doors, each door being hingedly attached to a respective side panel proximate to the front edge of the respective side panel such that the rear panel, the side panels, the bottom panel, and the doors in a closed configuration define a sleeping space, the sleeping space being substantially cuboid and open topped, the doors swinging outwardly from the closed configuration to an open configuration wherein the sleeping space is accessible by reaching between the doors;

the rear panel being continuous and without openings, the rear panel being dimensionally taller than the side panels, wherein the rear panel is configured for preventing a child in the sleeping space from contacting a wall proximate to the rear panel;

a latching device being attached to and extending between the doors such that the doors are selectively securable in the closed configuration;

wherein:

each side panel comprises a rear post defining the rear edge of the side panel, the rear panel being attached to and extending between the rear posts; and each side panel comprises a front post defining the front edge of the side panel, each door being hingedly attached to a respective front post;

a stiffening rail being attached to and extending between the front posts such that the stiffening rail is positioned above the doors in the closed configuration;

a plurality of linear actuators, each linear actuator of the plurality of linear actuators being attached to a respective rear post or a respective front post such that each rear post and each front post is fitted with an associated one of the linear actuators of the plurality of linear actuators, wherein the plurality of linear actuators is configured for selectively elevating the sleeping structure from a surface upon which the sleeping structure is positioned while maintaining the bottom panel parallel to the surface;

a controller being operationally engaged to the plurality of linear actuators, wherein the controller is configured for manipulation by a user for selectively actuating the plurality of linear actuators.

2. The front opening crib assembly of claim 1, wherein the rear posts and the front posts extend past the bottom panel defining front legs and of rear legs, respectively.

3. The front opening crib assembly of claim 1, wherein the controller comprises an up/down switch.

4. The front opening crib assembly of claim 1, further comprising:

the plurality of linear actuators comprising a plurality of hydraulic cylinders, each hydraulic cylinder comprising a piston, the piston being selectively extensible from the sleeping structure to engage the surface for elevating the sleeping structure from the surface; and a hydraulic pump being attached to the sleeping structure and operationally engaged to the plurality of hydraulic cylinders and to the controller.

5. The front opening crib assembly of claim 4, further comprising a plurality of footpads, each footpad of the plurality of footpads being attached to a respective piston such that the footpad is positioned for contacting the surface, wherein the plurality of footpads is configured for stabilizing the sleeping structure upon the surface.

6. The front opening crib assembly of claim 4, wherein:
each rear post is tubular and has a closed upper end and an open lower end;
each front post is tubular and has a closed top end and an open bottom end; and
each linear actuator of the plurality of linear actuators is positioned within a respective one of the rear posts and the front posts such that the pistons of the linear actuators positioned in the rear posts are selective extensible from their open lower ends and such that the pistons of the linear actuators positioned in the front posts are selective extensible from their open bottom ends.

7. The front opening crib assembly of claim 1, wherein:
the rear panel comprises a top support rail defining the top edge of the rear panel, the top support rail being attached to and extending between the rear posts; and the rear panel comprises a bottom support rail defining the bottom edge of the rear panel, the bottom support rail being attached to and extending between the rear posts.

8. The front opening crib assembly of claim 1, further comprising a lower support rail being attached to and extending between the front posts, the lower support rail being attached to the bottom panel.

9. The front opening crib assembly of claim 1, wherein each side panel comprises:
an upper rail defining the upper edge of the side panel;
a lower rail defining the lower edge of the side panel; and
a plurality of side balusters being attached to and extending between the upper rail and the lower rail such that the plurality of side balusters are substantially evenly spaced between the rear post and the front post of the side panel.

10. The front opening crib assembly of claim 1, wherein each door comprises:
a top rail having opposed ends:
a bottom rail having opposing ends;
a pair of end members, each end member being attached to the top rail proximate to a respective opposed end of the top rail, each end member also being attached to the bottom rail proximate to an associated opposing end of the bottom rail such that each end member extends between the top rail and the bottom rail; and
a plurality of front balusters being attached to and extending between the top rail and the bottom rail such that the plurality of front balusters are substantially evenly spaced between the end members of the pair of end members.

11. A front opening crib assembly comprising:
a sleeping structure comprising:
a rear panel having opposed edges, a top edge, and a bottom edge;
a pair of side panels, each side panel having a rear edge, a front edge, an upper edge, and a lower edge, each being attached proximate to a respective opposed edge of the rear panel such that the side panels extend perpendicularly to and in parallel from the rear panel;
a bottom panel being attached to of the side panels proximate to the lower edges of the side panels and to the rear panel proximate to the bottom edge of the rear panel, wherein the bottom panel is configured to support a mattress pad;
a pair of doors, each door being hingedly attached to a respective side panel proximate to the front edge of the respective side panel such that the rear panel, the side panels, the bottom panel, and the doors in a closed configuration define a sleeping space, the sleeping space being substantially cuboid and open topped, the doors swinging outwardly from the closed configuration to an open configuration wherein the sleeping space is accessible by reaching between the doors, each door comprises:
a top rail having opposed ends:
a bottom rail having opposing ends;
a pair of end members, each end member being attached to the top rail proximate to a respective opposed end of the top rail, each end member also being attached to the bottom rail proximate to an associated opposing end of the bottom rail such that each end member extends between the top rail and the bottom rail; and
a plurality of front balusters being attached to and extending between the top rail and the bottom rail such that the plurality of front balusters are substantially evenly spaced between the end members of the pair of end members;
the rear panel being continuous and without openings, the rear panel being dimensionally taller than the side panels, wherein the rear panel is configured for preventing a child in the sleeping space from contacting a wall proximate to the rear panel;
a latching device being attached to and extending between the doors such that the doors are selectively securable in the closed configuration;
each side panel comprising a rear post defining the rear edge of the side panel, the rear panel being attached to and extending between the rear posts, the rear post being tubular and having a closed upper end and an open lower end;
the rear panel comprising a top support rail defining the top edge of the rear panel, the top support rail being attached to and extending between the rear posts;
the rear panel comprising a bottom support rail defining the bottom edge of the rear panel, the bottom support rail being attached to and extending between the rear posts;
each side panel comprising a front post defining the front edge of the side panel, each door being hingedly attached to a respective front post, the front post being tubular and having a closed top end and an open bottom end;
each side panel comprises:
an upper rail defining the upper edge of the side panel;
a lower rail defining the lower edge of the side panel; and
a plurality of side balusters being attached to and extending between the upper rail and the lower rail such that the plurality of side balusters are substantially evenly spaced between the rear post and the front post of the side panel;
the rear posts and the front posts extending past the bottom panel defining front legs and rear legs, respectively;
a lower support rail being attached to and extending between the front posts, the lower support rail being attached to the bottom panel; and
a stiffening rail being attached to and extending between the front posts such that the stiffening rail is positioned above the doors in the closed configuration;

a plurality of linear actuators, each linear actuator of the plurality of linear actuators being attached to a respective rear post or a respective front post such that each rear post and each front post is fitted with an associated one of the linear actuators of the plurality of linear actuators, wherein the plurality of linear actuators is configured for selectively elevating the sleeping structure from a surface upon which the sleeping structure is positioned while maintaining the bottom panel parallel to the surface, the plurality of linear actuators comprising a plurality of hydraulic cylinders, each hydraulic cylinder comprising a piston, the piston being selectively extensible from the sleeping structure to engage the surface for elevating the sleeping structure from the surface, each linear actuator of the plurality of linear actuators being positioned within a respective one of the rear posts and the front posts such that the pistons of the linear actuators positioned in the rear posts are selective extensible from their open lower ends and such that the pistons of the linear actuators positioned in the front posts are selective extensible from their open bottom ends;

a plurality of footpads, each footpad of the plurality of footpads being attached to a respective piston such that the footpad is positioned for contacting the surface, wherein the plurality of footpads is configured for stabilizing the sleeping structure upon the surface;

a controller being operationally engaged to the plurality of linear actuators, wherein the controller is configured for manipulation by a user for selectively actuating the plurality of linear actuators, the controller comprises an up/down switch; and a hydraulic pump being attached to the sleeping structure and operationally engaged to the plurality of hydraulic cylinders and to the controller.

12. A method of using a selectively elevatable front opening crib, the method comprising the steps of:

providing a front opening crib assembly comprising:

a sleeping structure, the sleeping structure comprising:

a rear panel having opposed edges, a top edge, and a bottom edge;

a pair of side panels, each side panel having a rear edge, a front edge, an upper edge, and a lower edge, each rear edge being attached proximate to a respective opposed edge of the rear panel such that the side panels extend perpendicularly to and in parallel from the rear panel;

a bottom panel being attached to of the side panels proximate to the lower edges of the side panels and to the rear panel proximate to the bottom edge of the rear panel, wherein the bottom panel is configured to support a mattress pad;

a pair of doors, each door being hingedly attached to a respective side panel proximate to the front edge of the respective side panel such that the rear panel, the side panels, the bottom panel, and the doors in a closed configuration define a sleeping space, the sleeping space being substantially cuboid and open topped, the doors swinging outwardly from the closed configuration to an open configuration wherein the sleeping space is accessible by reaching between the doors;

the rear panel being continuous and without openings, the rear panel being dimensionally taller than the side panels, wherein the rear panel is configured for preventing a child in the sleeping space from contacting a wall proximate to the rear panel;

a latching device being attached to and extending between the doors such that the doors are selectively securable in the closed configuration;

each side panel comprising a rear post defining the rear edge of the side panel, the rear panel being attached to and extending between the rear posts;

each side panel comprising a front post defining the front edge of the side panel, each door being hingedly attached to a respective front post;

a stiffening rail being attached to and extending between the front posts such that the stiffening rail is positioned above the doors in the closed configuration;

a plurality of linear actuators, each linear actuator of the plurality of linear actuators being attached to a respective rear post or a respective front post such that each rear post and each front post is fitted with an associated one of the linear actuators of the plurality of linear actuators, wherein the plurality of linear actuators is configured for selectively elevating the sleeping structure from a surface upon which the sleeping structure is positioned while maintaining the bottom panel parallel to the surface; and a controller being operationally engaged to the plurality of linear actuators, wherein the controller is configured for manipulation by a user for selectively actuating the plurality of linear actuators;

manipulating the controller for elevating the sleeping structure to a height desired for positioning a child into the sleeping space;

swinging the doors outwardly such that the sleeping space is accessible;

positioning the child on the mattress pad in the sleeping space;

closing and latching the doors; and manipulating the controller to lower the sleeping structure to a desired resting height.

* * * * *